United States Patent [19]

Doctor

[11] Patent Number: 4,778,594

[45] Date of Patent: Oct. 18, 1988

[54] APPARATUS FOR MAGNETIC SEPARATION OF PARAMAGNETIC AND DIAMAGNETIC MATERIAL

[75] Inventor: Richard D. Doctor, Glen Ellyn, Ill.

[73] Assignee: The University of Chicago (Arch Development Corp.), Chicago, Ill.

[21] Appl. No.: 889,131

[22] Filed: Jul. 24, 1986

[51] Int. Cl.[4] ..... B03C 1/26

[52] U.S. Cl. ..... 209/224; 209/232

[58] Field of Search ..... 209/214, 215, 224, 225, 209/231; 44/1 SR

[56] References Cited

U.S. PATENT DOCUMENTS

| | | | |
|---|---|---|---|
| 3,452,865 | 7/1969 | Eckhardt | 209/225 |
| 4,239,619 | 12/1980 | Aplan et al. | 209/224 |
| 4,340,468 | 7/1982 | Hise, Jr. et al. | 209/224 |
| 4,608,155 | 8/1986 | Desportes et al. | 209/224 |

FOREIGN PATENT DOCUMENTS

| | | | |
|---|---|---|---|
| 1017552 | 6/1957 | Fed. Rep. of Germany | 209/225 |
| 254030 | 7/1926 | United Kingdom | 209/224 |

OTHER PUBLICATIONS

Doctor et al., "The Development of Open-Gradient Magnetic Separation for Coal Cleaning Using a Super Conducting Quadropole Field", AIChE, Aug. 25-28, 1985.

Herdan, "Small Particle Statistics", 2nd Edition, Academic Press, New York, (1960).

Liu et al., "Studies in Magnetochemical Engineering", AIChE Journal, p. 771, Sep. 1983.

Smith et al., "A Safe, Low Current, High Gradient, Superconducting, Quadrupole Magnet for High Energy Physics Beam Transport, Knoxville, TN, 1982.

"Coal Preparation Using Magnetic Separation", vols. 1-5, EPRI, 1980.

*Primary Examiner*—Sherman D. Basinger
*Assistant Examiner*—Edwin L. Swinehart
*Attorney, Agent, or Firm*—Michael D. Rechtin

[57] ABSTRACT

The present invention relates to methods and apparatus for segregating paramagnetic from diamagnetic particles in particulate material and, in particular, to the open gradient magnetic separation of ash producing components and pyritic sulfur from coal. The apparatus includes a vertical cylinder and a rotatable vertical screw positioned within the cylinder, the screw having a helical blade angled downwardly and outwardly from the axis. Rotation of the vertical screw causes denser particles, which in the case of coal include pyritic sulfur and ash, which are paramagnetic, to migrate to the outside of the screw, and less dense particles, such as the low sulfur organic portion of the coal, which are diamagnetic, to migrate towards the center of the screw. A vibration mechanism attached to the screw causes the screw to vibrate during rotation, agitating and thereby accommodating further segregation of the particles. An open gradient magnetic field is applied circumferentially along the entire length of the screw by a superconducting quadropole magnet. The open gradient magnetic field further segregates the paramagnetic particles from the diamagnetic particles. The paramagnetic particles may then be directed from the cylinder into a first storage bin, and the diamagnetic particles, which are suitable for relatively clean combustion, may be directed into a second storage bin.

16 Claims, 3 Drawing Sheets

APPARATUS FOR MAGNETIC SEPARATION OF PARAMAGNETIC AND DIAMAGNETIC MATERIAL

CONTRACTUAL ORIGIN OF THE INVENTION

The United States has rights in this invention pursuant to Contract No. W-31-109-Eng-38 between the United States Department of Energy and The University of Chicago, Operator of Argonne National Laboratory.

BACKGROUND OF THE INVENTION

This invention relates generally to apparatus for segregating relatively dense paramagnetic particles from relatively light diamagnetic particles, and more particularly to magnetic devices for separating particles having a high mineral and pyritic sulfur content from particles of organic coal in order to reduce the overall mineral and sulfur content of the coal.

Treatment of coal to remove sulfur content is well established commercially for both metallurgical and steam generation markets. The most widely used systems employ liquid mediums to separate organic coal from mineral and iron pyrite inclusions. Such conventional systems are operable in part because the mineral and iron pyrite inclusions are generally denser than the organic coal. However, the use of conventional coal cleaning processes in cleaning fine size coals is not economical. This is especially true of fine coal fractions that have been cleaned successfully into a relatively low ash product, but have poor thermal recoveries because of the surface moistures that cling to fine coal. The requirements for separating, handling, and dewatering fine sized coal are so expensive that a significant fraction is usually rejected to the waste pond. Processes such as magnetic beneficiation that are operated on a dry rather than a wet coal feed are therefore preferable.

It has been observed experimentally that when pulverized coal passes freely through a magnetic field gradient, the mineral components tend to separate from the organic components because of the different inherent magnetic characteristics of the mineral and organic components of the coal. The inorganic iron pyrites (iron disulfide) and ash producing components are paramagnetic in part because of the inclusion of trace concentrations of monoclinic iron pyrrohotite. In contrast, the organic components (including the "clean coal") are diamagnetic.

A paramagnetic particle becomes slightly magnetized in the presence of a magnetic field so that, if the field is non-uniform, the particle will be drawn toward the region of higher field intensity. A diamagnetic particle behaves exactly the opposite, and tends to move in the direction of lower field intensity. Open gradient magnetic separation (OGMS) takes advantage of these characteristics to separate the organic fraction of the coal from the inorganic ash and pyritic fraction. A further discussion on the physical basis for this separation is to be found in R. D. Doctor, C. B. Panchal, C. Swietlik, "The Development of Open Gradient Magnetic Separation for Coal Cleaning Using a Superconducting Quadropole Field," Paper 48e, AICHE National Meeting (1985).

Recent interest in magnetic coal beneficiation techniques has focused on the application of high gradient magnetic separation (HGMS), which has been used commercially for beneficiation of mineral ores. In HGMS, a grid of ferromagnetic filaments are placed in a uniform magnetic field. The necessary high gradients are induced locally around the ferromagnetic filaments, and paramagnetic minerals are trapped on the filaments. When the filaments are moved out of the magnetic field the particles will fall off. Thus, HGMS is useful in intermittent or batch type processes.

The use of superconducting magnetic devices for the beneficiation of coal was suggested in the work entitled "Initial Exploration of Application of Open Gradient Magnetic Separation of Coal to Beneficiation of Liquification Feeds" by E. C. Hise, Oak Ridge, Tenn., ORNL/TM8529 published February, 1983. However, the system of Hise describes coal dropping through an open gradient field with the pyritic material and ash tending to become attached to the wall of the bore through which the coal is passing. While the Hise system operates effectively at low flow rates, it experiences significant difficulties in overcoming particle-particle interaction when large numbers of particles are present. Hence, it is of limited suitability for many commercial applications.

Screw-type separators have been used in magnetic separation systems to remove foreign particles from oil and other feed materials. However, such separators also have not been useful in systems which employ high flow rates. Thus, there is a need for improved apparatus and methods for segregating paramagnetic particles from diamagnetic particles, particularly in coal, at a relatively high flow rate. There is also a need for improved apparatus and methods for segregating paramagnetic particles from diamagnetic particles which are suitable for commercial applications where large numbers of particles are present.

Accordingly, an object of the present invention is to provide new and improved apparatus for segregating paramagnetic particulate material from diamagnetic particulate material.

Another object of this invention is to provide new and improved high speed, continuous, low cost methods and apparatus for separation of paramagnetic and diamagnetic particles in general, and in particular, for separation of ash and pyrite from coal, so as to substantially reduce the sulfur content of the coal.

It is an additional object of the invention to provide new and improved apparatus that combines forces of vibration, gravity and magnetic flux to separate paramagnetic particles from diamagnetic particles.

SUMMARY OF THE INVENTION

In the present invention an apparatus is provided for segregating magnetic particulate material from diamagnetic particulate material. A vertical cylinder is provided having a wall and a bore extending axially through the cylinder. A rotatable vertical screw is positioned in the bore. The screw has a shaft and a helical blade which is angled downwardly in the radial direction as well as the axial direction.

A motor and drive mechanism are used for rotating the screw so that particulate matter placed in the bore is moved in the downward direction. As the screw rotates, particulate matter in the bore is agitated, and the forces of gravity draw relatively dense matter towards the radially outward regions of the helical blade, causing separation of the denser material from the less dense material.

A vibrating mechanism is attached to the screw to cause the screw to vibrate during rotation, thereby further segregating the denser material from the less dense material.

An open-gradient magnetic field is applied circumferentially along substantially the entire length of the screw, utilizing a superconducting quadrupole magnet which creates a magnetic field gradient having its greatest strength at the wall of the cylinder. The magnetic field segregates paramagnetic particles from diamagnetic particles, repelling the diamagnetic particles from the magnet toward the shaft of the screw and attracting the paramagnetic particles toward the wall of the cylinder. In cases where the paramagnetic material is denser than the diamagnetic material, as is often the case in coal, the magnetic forces combine with the forces of gravity and vibration to separate the paramagnetic materials from the diamagnetic materials. In other cases, the magnetic forces and forces of vibration alone combine to agitate and separate the materials. Since the paramagnetic particles in coal generally have high mineral and sulfur content, they are directed from the apparatus as waste. The diamagnetic particles in coal, which have a high organic content, are recovered as usable product.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings in which.

DETAILED DESCRIPTION

Figure 1:
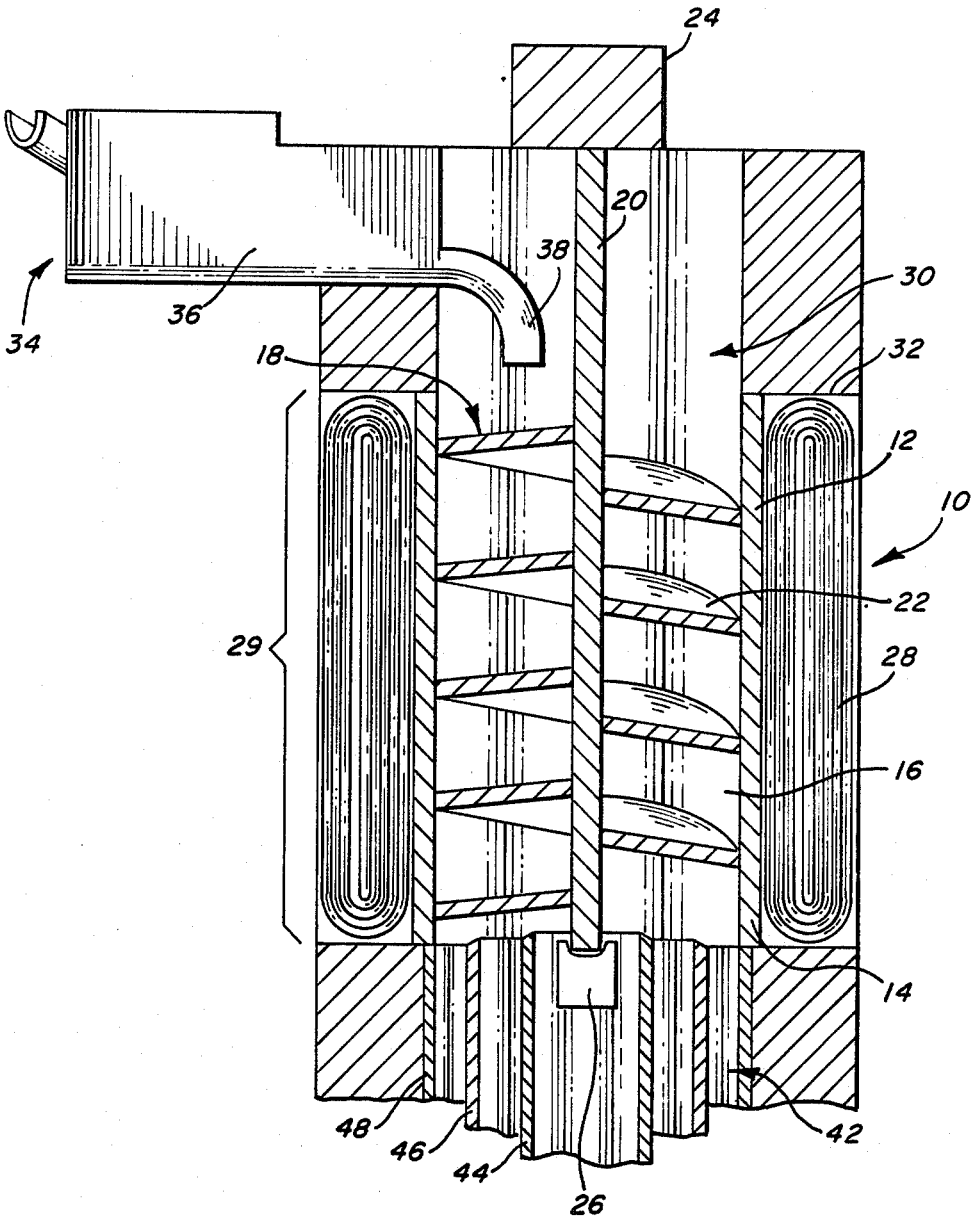
FIG. 1 is an elevational view taken in section of an apparatus for separating diamagnetic and paramagnetic particulate material.

FIG. 1 shows an apparatus 10 for separating dry paramagnetic particulate material from dry diamagnetic particulate material. A vertical cylinder 12 is provided having a wall 14 and a bore 16 extending axially through the cylinder 12. A rotatable vertical screw 18 is axially disposed within the cylinder 12. The screw 18 includes a shaft 20 and a helical blade 22. The helical blade 22 is angled downwardly in both the radial and the axial directions, and extends substantially to the wall 14. The screw 18 is connected to a motor 24 which rotates the screw 18 so that particulate matter which enters the apparatus at the top of the screw 18 is carried in the downward direction by the screw 18.

A vibration drive 26 is operatively connected to the screw 18 to vibrate the screw 18 during rotation. Vibration may be effected by an electric motor or an ultrasonic transducer, or other commonly known vibration generating devices.

A magnet 28 is disposed around substantially the entire length of the wall 14 of the cylinder 12. The magnet 28 applies a magnetic field in the bore 16.

In one embodiment, the magnet 28 is a superconducting quadrupole magnet which imposes a radial gradient field within the bore 16. The field is the strongest at the wall 14, and decreases as it approaches the shaft 20. The magnetic field is substantially constant in a central zone 29, and has an axial gradient in a fringe zone 30. The field in the fringe zone 30 decreases in strength in the upward direction from a top 32 of the magnet 28. In a suggested embodiment, the magnet 28 could be 0.75 meters in length, with a gradient of 60 Webers per cubic meter at a peak operating current of 1100 Amperes. The superconducting quadropole magnet 28 may be similar in construction to a superconducting magnet described in an article entitled "A Safe Low Current, High Gradient, Superconducting, quadrupole Magnet for High Energy Physics Beam Transport", R. P. Smith et al., Applied Superconducting Conf. 1982, Knoxville, Tenn., which is hereby incorporated by reference.

Returning to FIG. 1, quadrupole magnets such as the magnets which may be utilized in the magnet 28 are capable of producing very uniform magnetic field gradients through a relatively large working volume in a cylindrical bore. Superconducting magnets, operating at temperatures on the order of 4° K., are able to generate intense magnetic field gradients with very low power consumptions. Once energized, the electricity consumption in the magnet is negligible and only the refrigeration power is significant. One estimate for a magnetic separation process puts the energy savings of superconducting magnets over conventional magnets at about 75%. Thus, superconducting magnets in the present application significantly reduce the cost of operation of the apparatus.

In order to more effectively utilize the apparatus 10, the particulate matter is preferably pulverized by a pulverized 34, shown in block form in FIG. 1, prior to passage into the cylinder 12. Any one of several commercially available pulverizing systems such as jawcrushers, ball mills, disintegrators or rolling mills can be used so that 98% of the particulate matter has a size in the range of between about 44 and about 150 microns. When the particulate matter is coal having a relatively high content of undesired minerals and pyrites, the objective of the grinding is to optimize the liberation of mineral and pyrite inclusions in the coal matrix. However, this size restriction of about 44 to about 150 microns is highly dependent upon the "washability" of the specific coal undergoing beneficiation, and is subject to modest variation. Particles of a diameter smaller than 44 microns are subject to dust and handling problems in any coal preparation system and typically are removed for this reason. Jawcrushers, ball mills, disintegrators, and roller mills characteristically produce particle size distributions that are different from each other. That is, when the size distribution versus cumulative percentage of product present is plotted on a probability curve, different shaped curves result from each pulverizing device. Using the methods outlined by Herdan, "Small Particle Statistics", 2d Ed., Academic Press, N.Y. 1960, page 187, which is hereby incorporated by reference, a minimum density-maximum void mix for a specific coal may be obtained for desired separation in the apparatus 10.

As shown generally in FIG. 1, from the pulverizer 34 the particulate material is moved by means of an auger 36, shown in block form, or other suitable device, to a flexible feeder 38. The particulate material is directed to a desired area of the helical blade 22 by the feeder 38. The rotation of the vertical screw 18 then feeds the particulate matter through the apparatus 10. The screw 18 is placed so that it is below the fringe zone 30 of the magnetic field of magnet 28 and in the central magnetic zone 29 of the apparatus 10.

The manner in which particulate matter may be segregated in the apparatus 10 may now be seen. In general, particulate manner will include both paramagnetic particles and diamagnetic particles. While the size of the particles will generally be within certain limits, the densities of the paramagnetic and diamagnetic particles may depend on the composition of the particles. In coal, for example, paramagnetic particles are generally denser than diamagnetic particles. When the particles are mixed and then agitated, the forces of gravity draw the denser particles down, forcing the less dense particles to the surface. In this manner, the forces of gravity segregate the denser particles from the less dense particles.

When the particulate matter includes both paramagnetic particles and diamagnetic particles, as is the case with some grades of coal, the magnetic field created by the magnet 28 further segregates the paramagnetic particles from the diamagnetic particles. The paramagnetic particles are magnetized by the field and are drawn toward the wall 14, because the strongest magnetic field appears at the wall 14. The diamagnetic particles are not magnetized in the same manner, and migrate toward the shaft 20. Migration of all of the particles is facilitated by the turning of the screw 18 by the motor 24, and the vibrations of the screw 18 by the vibrator 26.

Figure 2:
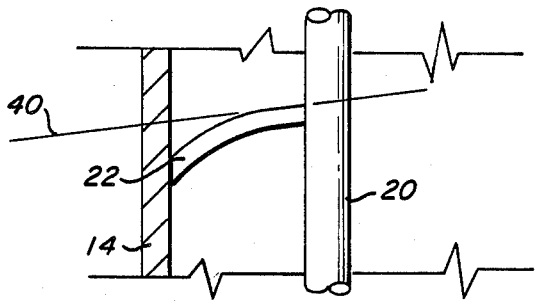
FIG. 2 is a detail view showing one embodiment of the shape of the helical blade of the apparatus of the FIG. 1.
Figure 3:
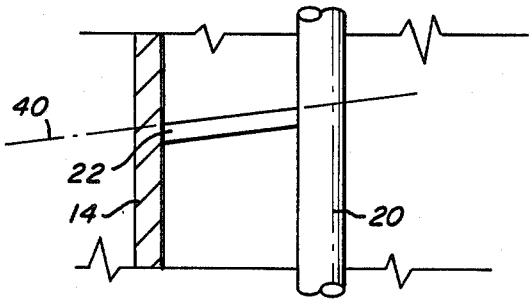
FIG. 3 is a detail view of another embodiment of the shape of the helical blade of the apparatus of FIG. 1.
Figure 4:
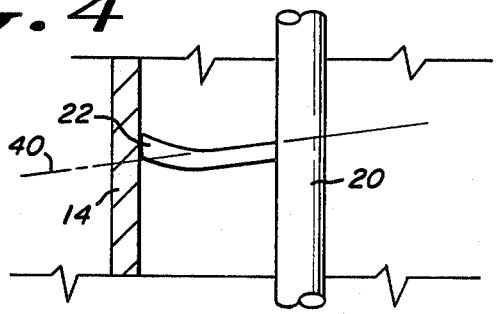
FIG. 4 is a detail view of yet another embodiment of the shape of the helical blade of the apparatus of FIG. 1.

The helical blade 22 may take different forms, depending upon the density characteristics of the particulate matter being segregated by the apparatus 10. Various helical blade shapes are shown in FIGS. 2, 3 and 4, although other shapes are contemplated. FIG. 2 shows a blade shape which could be used for segregating particulate material such as certain grades of coal, where the paramagnetic particles are generally denser than the diamagnetic particles. The blade 22 slopes downwardly from the shaft 20 generally along a line 40, but as the blade 22 approaches the wall 14, the blade 22 slopes downwardly below the line 40, at any suitable pitch. The added pitch tends to draw the denser particles toward the wall 14 and trap them, while less dense particles tend to migrate toward the shaft 20 and remain on the relatively less inclined slope.

FIG. 3 shows a blade shape adapted for segregating materials in which the density of the paramagnetic particles is about the same as the density of the diamagnetic particles. The blade 22 extends along the line 40 from the shaft 20 to the wall 14. The shape is intended to increase the segregating effect of the magnetic and vibrational forces on the particles, without the benefit of gravitational forces. This is accomplished in part by not inextricably trapping particles adjacent to the wall 14, as is more likely to occur in FIG. 2.

FIG. 4 shows a blade shape adapted for segregating materials in which the density of diamagnetic particles is denser than the paramagnetic particles. The blade 22 extends along the line 40 from the shaft 20, but curves upwardly above the line 40 as the blade 22 approaches the wall 14. The upward pitch permits the forces of gravity to draw the denser diamagnetic particles toward the shaft 20. Since the magnetic forces act on the diamagnetic particles in the same manner, the shape of the blade 22 permits the magnetic and gravitational forces to act together.

It can now be seen how magnetic, gravitational, rotational and vibrational forces combine to segregate particulate matter which enters the bore 16. It can also be seen that the segregated particles will eventually fall off of the blade 22 at the bottom of the central zone 29. A splitter 42 (FIG. 1) is provided beneath the screw 22 which isolates the segregated particles from each other for removal or further processing. In one embodiment, the splitter 42 has three concentric tubes 44, 46 and 48. The tube 44 isolates the particles which are closest to the shaft 20. That group of particles is likely to include the highest percentage of diamagnetic particles. The tube 46 isolates the particles which are in the center portion of the blade 22, which are likely to have a significant percentage of both paramagnetic and diamagnetic particles, and the tube 48 isolates the particles which are closest to the wall 14 and are likely to have the highest percentage of paramagnetic particles.

Figure 5:
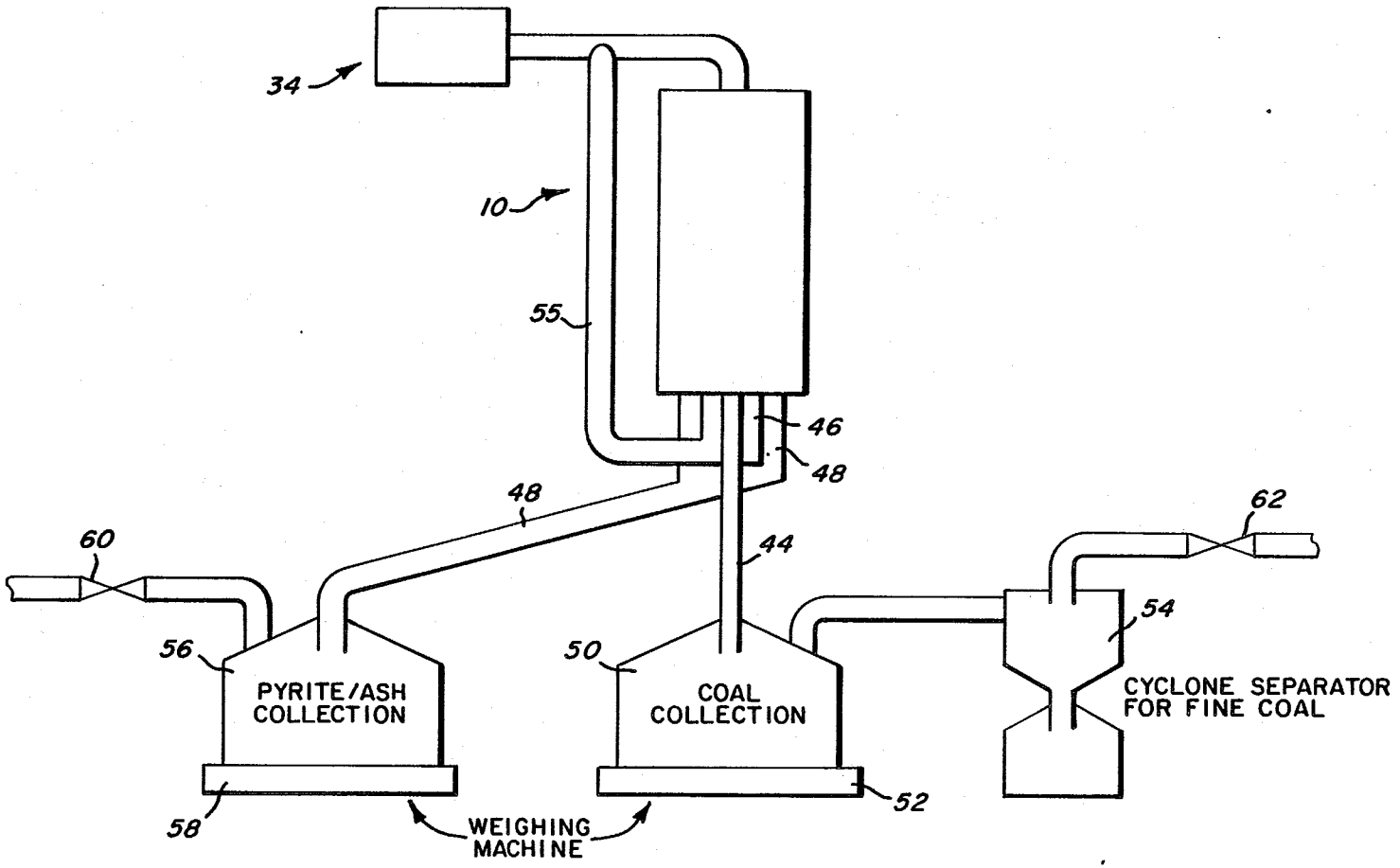
FIG. 5 is a block diagram of a system for processing coal with the apparatus of FIG. 1.

FIG. 5 shows the apparatus 10 in a coal beneficiation system. From the concentric tube 44, the diamagnetic particles are conveyed by means of an auger (not shown) or by gravity to a coal collection bin 50. Those particles may be used for combustion or other purposes. A weighing scale 52 measures the quantity of coal collected. A cyclone separator 54 may be provided for processing the coal further by separating finer coal particles from larger particles.

The mixed particles collected in the tube 46 may be returned to the apparatus 10 by a pipe 55 or other suitable means for further processing, to increase the effective yield of usable coal.

The concentric tube 48 collects the denser paramagnetic particles, which in coal are undesired pyrite and ash. A collector 56 is provided for storing the undesired particles, and a weighing scale 58 measures the quantity of pyrite and ash particles collected. Both pyrite and ash collector 56 and coal bin 50 may be vented through filters 60 and 62, respectively, so as to prevent an airlock.

Accordingly, the apparatus of this invention segregates particulate material into paramagnetic and diamagnetic particles in dry, continuous operation at high speed and relatively low cost.

While the present invention is susceptible of embodiment in many different forms, there is shown in the drawings and described in the detailed description several specific embodiments, with the understanding that the invention is not limited thereto except insofar as those who have the disclosure before them are able to make modifications and variations therein without departing from the scope of the invention.

What is claimed is:

1. Apparatus for segregating paramagnetic particles from diamagnetic particles comprising:

a substantially vertical cylinder having a cylindrical wall and a bore extending inside said wall;

means for placing said particulate material in said vertical cylinder;

a rotatable vertical screw within said cylinder, said screw having a shaft which extends through the center of said bore and a helical blade, at least a portion of said helical blade being angled downwardly from said shaft over at least part of the radial direction, said blade extending substantially to said wall of said cylinder;

means for rotating said screw so as to agitate said diamagnetic and paramagnetic particles;

means for applying a magnetic field around substantially the entire length of said screw, said magnetic field having a radial gradient from said axis to said wall so as to segregate said paramagnetic particles from said diamagnetic particles; and means for removing said segregated paramagnetic and diamagnetic particles from said cylinder and isolating said paramagnetic particles from said diamagnetic particles.

2. The apparatus of claim 1 wherein said paramagnetic particles have a density which is greater than the density of said diamagnetic particles.

3. The apparatus of claim 2 wherein said downward angle of said blade increases as said blade approaches said wall.

4. The apparatus of claim 1 wherein said paramagnetic particles have a density which is about the same as the density of said diamagnetic particles.

5. The apparatus of claim 4 wherein said downward angle of said blade is substantially constant as said blade approaches said wall.

6. The apparatus of claim 1 wherein said paramagnetic particles have a density which is lower than the density of said diamagnetic particles.

7. The apparatus of claim 6 wherein said angle of said blade becomes an upward angle in the radial direction as said blade approaches said wall.

8. The apparatus of claim 1 and further comprising means for vibrating said screw during rotation so as to further agitate said paramagnetic and diamagnetic particles.

9. The apparatus of claim 1 wherein said means for applying a magnetic field comprises a quadropole magnet and said gradient field has decreasing strength from said wall to the center of said bore.

10. The apparatus of claim 9 wherein said magnet comprises a superconducting magnet.

11. The apparatus of claim 10 wherein said quadropole magnet has a gradient field of approximately 60 Webers/$m^3$.

12. The apparatus of claim 1 wherein said means for removing and isolating said paramagnetic and diamagnetic particles comprises a plurality of concentric tubes of progressively smaller inside diameter, sized and positioned under said vertical cylinder so as to receive said paramagnetic particles which are disposed proximate said wall of said vertical cylinder in one of said tubes, and to receive said diamagnetic particles which are disposed proximate the center of said vertical cylinder in another of said tubes.

13. The apparatus of claim 1 wherein said paramagnetic particles comprise pyritic sulfur and ash and said diamagnetic particles comprise coal.

14. A method of segregating paramagnetic particles from diamagnetic particles, said paramagnetic particles having a greater density than the diamagnetic particles, said method utilizing a cylinder, a screw having a helical blade in the cylinder, and means for applying a magnetic field along substantially the entire length of the cylinder, the magnetic field having increased strength near the cylinder and decreased strength near the center of the cylinder, said method comprising the steps of:

rotating said helical blade so as to agitate the paramagnetic and diamagnetic particles; and generating a magnetic field about said screw so as to attract the paramagnetic particles toward the cylinder for subsequent disposal thereof, and to repel the diamagnetic particles toward the center of the cylinder, for subsequent recovery thereof.

15. The method of claim 14 wherein the screw further includes means for effecting vibration of the helical blade, said method comprising the additional step of vibrating the screw so as to enhance the segregation of the paramagnetic particles from the diamagnetic particles.

16. A method for segregating paramagnetic particles from diamagnetic particles, said paramagnetic particles having a greater density than the diamagnetic particles, said method comprising the steps of:

charging to a containment cylinder a mixture of said paramagnetic and diamagnetic particles;

rotating a helical blade disposed within said containment cylinder at a rapid rate to agitate and transport said paramagnetic and diamagnetic particles;

agitating the mixture of said particles by vibrating said cylinder; and generating a magnetic field about said helical blade to attract said paramagnetic particles toward said containment cylinder surrounding said helical blade and repelling said diamagnetic particles toward the longitudinal center of said helical blade for isolation from said paramagnetic particles, said separation occurring at a rapid rate as a consequence of said rapidly rotating helical blade and said step of agitating.

* * * * *